US009422782B2

(12) United States Patent
McWhorter et al.

(10) Patent No.: US 9,422,782 B2
(45) **Date of Patent: *Aug. 23, 2016**

(54) CONTROL POD FOR BLOWOUT PREVENTER SYSTEM

(71) Applicant: Cameron International Corporation, Houston, TX (US)

(72) Inventors: David J. McWhorter, Cypress, TX (US); Mac M. Kennedy, Tomball, TX (US); Edward C. Gaude, Tomball, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/074,536

(22) Filed: Mar. 18, 2016

(65) Prior Publication Data

US 2016/0201420 A1 Jul. 14, 2016

Related U.S. Application Data

(63) Continuation of application No. 14/667,471, filed on Mar. 24, 2015, now Pat. No. 9,291,020, which is a continuation of application No. PCT/US2013/069397, filed on Nov. 11, 2013.

(60) Provisional application No. 61/725,091, filed on Nov. 12, 2012.

(51) Int. Cl.

| | |
|---|---|
| ***E21B 33/035*** | (2006.01) |
| ***E21B 33/064*** | (2006.01) |
| ***E21B 47/12*** | (2012.01) |
| ***E21B 33/06*** | (2006.01) |

(52) U.S. Cl.
CPC ..... *E21B 33/0355* (2013.01); *E21B 33/061* (2013.01)

(58) Field of Classification Search
CPC .... E21B 33/0355; E21B 33/064; E21B 47/12
See application file for complete search history.

(56) References Cited

U.S. PATENT DOCUMENTS

| | | | | |
|---|---|---|---|---|
| 5,676,209 | A * | 10/1997 | Reynolds | E21B 17/012 166/345 |
| 6,009,950 | A | 1/2000 | Cunningham et al. | |
| 6,032,742 | A * | 3/2000 | Tomlin | E21B 33/063 166/345 |
| 6,422,315 | B1 * | 7/2002 | Dean | E21B 33/038 166/339 |
| 6,622,799 | B2 * | 9/2003 | Dean | E21B 33/038 166/339 |

(Continued)

*Primary Examiner* — Matthew R Buck
(74) *Attorney, Agent, or Firm* — Eubanks PLLC

(57) ABSTRACT

A blowout preventer system includes a blowout preventer stack having hydraulic components. The blowout preventer stack is coupled to a lower marine riser package that includes additional hydraulic components. The lower marine riser package includes control pods that enable redundant control of the hydraulic components of the blowout preventer stack and the additional hydraulic components of the lower marine riser package. These control pods include frames, valves, and stack stingers that facilitate connection of the control pods to hydraulic components of the blowout preventer stack, but do not include riser stingers that facilitate communication of control fluid to the additional hydraulic components of the lower marine riser package. The stack stingers extend through central apertures of bottom plates of the control pod frames and facilitate communication of control fluid from the valves to the hydraulic components of the blowout preventer stack. Additional systems, devices, and methods are also disclosed.

10 Claims, 10 Drawing Sheets

(56) References Cited

U.S. PATENT DOCUMENTS 6,938,695 B2 * 9/2005 Williams ..... E21B 33/038 166/341
7,261,162 B2 * 8/2007 Deans ..... E21B 41/0007 166/250.01
7,757,772 B2 * 7/2010 Donohue ..... E21B 33/0355 166/338
7,921,917 B2 * 4/2011 Kotrla ..... E21B 33/035 166/339
8,376,051 B2 * 2/2013 McGrath ..... E21B 33/06 166/344
8,393,399 B2 * 3/2013 Judge ..... E21B 33/076 166/344
8,464,797 B2 * 6/2013 Singh ..... E21B 33/0355 166/340
9,291,020 B2 * 3/2016 McWhorter ..... E21B 33/064
2010/0155073 A1 * 6/2010 Blank ..... E21B 34/16 166/338
2013/0167944 A1 * 7/2013 Egeland ..... E21B 33/064 137/15.18

* cited by examiner

CONTROL POD FOR BLOWOUT PREVENTER SYSTEM

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly through which the resource is accessed or extracted. These wellhead assemblies may include a wide variety of components, such as various casings, valves, fluid conduits, and the like, that control drilling or extraction operations.

Subsea wellhead assemblies typically include control pods that operate hydraulic components and manage flow through the assemblies. The control pods may route hydraulic control fluid to and from blowout preventers and valves of the assemblies via hydraulic control tubing, for instance. When a particular hydraulic function is to be performed (e.g., closing a ram of a blowout preventer), a control pod valve associated with the hydraulic function opens to supply control fluid to the component responsible for carrying out the hydraulic function (e.g., a piston of the blowout preventer). To provide redundancy, American Petroleum Institute Specification 16D (API Spec 16D) requires a subsea wellhead assembly to include two subsea control pods for controlling hydraulic components and the industry has built subsea control systems in this manner (with two control pods) for over forty years. This redundant control ensures that failure of a single control pod of a control system does not result in losing the ability to control the hydraulic components of the subsea stack. But such a failure of a single control pod causes the system to no longer comply with API Spec 16D, often leading an operator to shutdown drilling or other wellhead assembly operations until the malfunctioning control pod can be recovered to the surface and repaired. In the case of deep water operations, such recovery and repair can often take days and may cost an operator millions of dollars in lost revenue. Consequently, there is a need to increase the reliability of subsea control systems to reduce downtime and costs of operation.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to a subsea control system that includes control pods for operating components of a blowout preventer apparatus. The control pods in some instances are installed on a lower marine riser package that can be connected to a blowout preventer stack. A control pod in accordance with one embodiment includes a stack stinger that facilitates connection of the control pod to hydraulic components of the blowout preventer stack. The control pod can also include valves for routing control fluid to the hydraulic components of the blowout preventer stack and a control pod frame having a bottom plate with a central aperture, with the valves mounted within the control pod frame. The stack stinger extends through the central aperture of the bottom plate of the control pod frame and facilitates communication of control fluid from the valves to the hydraulic components of the blowout preventer stack through the stack stinger. Further, in at least one embodiment, the control pod does not include a riser stinger that facilitates communication of control fluid to additional hydraulic components of a lower marine riser package.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
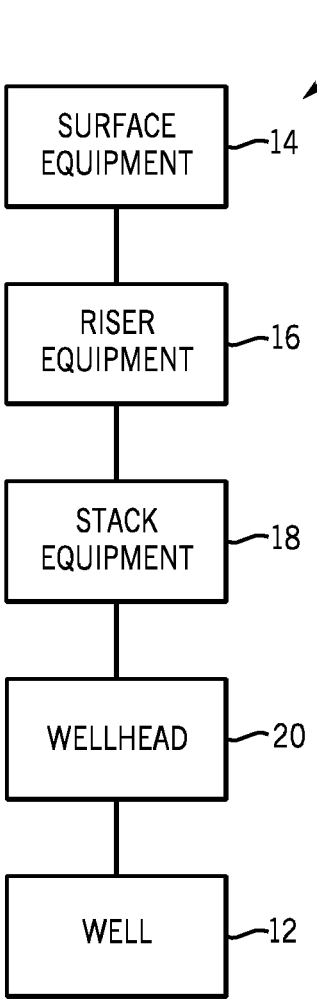
FIG. 1 generally depicts a subsea system for accessing or extracting a resource, such as oil or natural gas, via a well in accordance with an embodiment of the present disclosure.

Turning now to the present figures, a system 10 is illustrated in FIG. 1 in accordance with one embodiment. Notably, the system 10 (e.g., a drilling system or a production system) facilitates accessing or extraction of a resource, such as oil or natural gas, from a well 12. As depicted, the system 10 is a subsea system that includes surface equipment 14, riser equipment 16, and stack equipment 18, for accessing or extracting the resource from the well 12 via a wellhead 20. In one subsea drilling application, the surface equipment 14 is mounted to a drilling rig above the surface of the water, the stack equipment 18 (i.e., a wellhead assembly) is coupled to the wellhead 20 near the sea floor, and the riser equipment 16 connects the stack equipment 18 to the surface equipment 14.

As will be appreciated, the surface equipment 14 may include a variety of devices and systems, such as pumps, power supplies, cable and hose reels, control units, a diverter, a gimbal, a spider, and the like. Similarly, the riser equipment 16 may also include a variety of components, such as riser joints, flex joints, fill valves, control units, and a pressure-temperature transducer, to name but a few. The stack equipment 18, in turn, may include a number of components, such as blowout preventers, that enable the control of fluid from the well 12.

Figure 2:
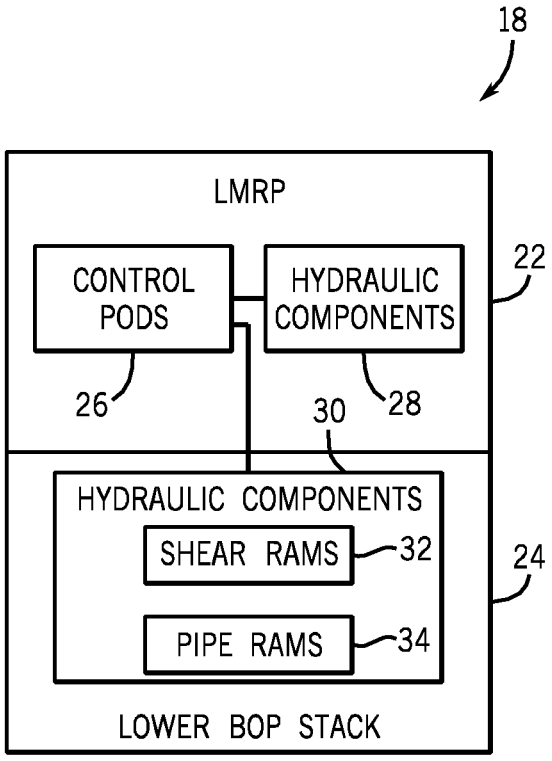
FIG. 2 is a block diagram of various components of the stack equipment of FIG. 1 in accordance with one embodiment.

In one embodiment generally depicted in FIG. 2, the stack equipment 18 includes a lower marine riser package (LMRP) 22 coupled to a lower blowout preventer (BOP) stack 24. The lower marine riser package 22 includes control pods 26 for controlling hydraulic components 28 and 30. The components 28 and 30 perform various hydraulic functions on the stack equipment 18, including controlling flow from the well 12 through the stack equipment 18. In the depicted embodiment, the components 30 of the lower blowout preventer stack 24 include hydraulically controlled shear rams 32 and pipe rams 34 (of a ram-type blowout preventer). But it will be appreciated that the stack equipment 18 may include many hydraulic functions that would be performed by the hydraulic components 28 and 30. By way of example, in various embodiments the hydraulic components 28 and 30 collectively include annular blowout preventers, other ram-type blowout preventers, and other valves to name but a few. The control pods 26 are connected to the components 28 and 30 by suitable conduits (e.g., control tubing or hoses). This allows the control pods 26 to route hydraulic control fluid to the components 28 and 30 to cause these components to perform their intended functions, such as closing the rams of a blowout preventer or opening a valve.

Because of the importance of the functions performed by hydraulic components of a wellhead assembly, it has become an industry standard to include two redundant control pods for controlling the hydraulic components of the wellhead assembly. These two redundant control pods are functionally identical (i.e., each of the control pods is capable of independently controlling the same hydraulic functions of the wellhead assembly), and the control pods are distinguishable from backup control systems different from the control pods, such as acoustical control systems, deadman's switches, and autoshear systems that provide limited redundancies for only a certain subset of functions controlled by the control pods.

Although the control pods may be generally reliable, over time the control pods can fail and lead to shutdown of drilling operations until the source of the malfunction can be identified and repaired. As noted above, such a failure can lead to significant and costly downtime. Although the use of two control pods provides redundancy, it also increases the likelihood that at least one control pod will experience a failure condition that would lead an operator to stop drilling operations. As an example, if each of the two control pods of a blowout preventer system has a reliability rate of 99% over a given time period (i.e., a failure rate of 1%), the chance that at least one or the other of the two control pods would fail is almost twice as high (a system reliability rate of 98.01% and a failure rate of 1.99% over the given time period, wherein system reliability or failure is based on continued, proper functioning of two control pods). Given the costs of such failure, there has been a long-felt need in the industry to increase reliability of control pods and associated systems in a cost-efficient manner. Because the failure rate of a control pod depends on the failure rate of each component, past efforts at increasing reliability have been focused on increasing the reliability of the individual components of a control pod. But control pods include numerous valves and other components, and significantly increasing the reliability of these components can result in components that are greatly increased in size, that are made with more expensive materials or techniques, or both. And as reliability of the control pod depends on the reliability of all of its components, such an increase in size or cost can significantly impact the size and cost of the control pod.

Rather than following the trend of increasing efforts to wring out incremental improvements in the reliability of a control pod and its components, embodiments of the present disclosure instead include at least one extra control pod in addition to the typical two control pods. In some embodiments, the at least one extra control pod is functionally identical to the first two control pods (i.e., each of the three control pods controls all of the same hydraulic components). This added layer of redundancy will greatly impact reliability of a blowout preventer system, as the system could continue operations in accordance with API Spec 16D even upon the failure of one of the control pods (or, more generally in the case of a system having more than three control pods, the failure of N−2 control pods, where N is the total number of control pods).

The increased reliability of a blowout preventer system with three control pods may be better appreciated with further consideration of the example noted above, in which control pods have a reliability rate of 99% (and a failure rate of 1%) over a given time period. With the additional level of redundancy represented by a third control pod, the system can continue operating in accordance with API Spec 16D even if one of the control pods fails or otherwise malfunctions. As a result, such a blowout preventer system with three control pods would have a reliability rate of 99.9702% and a failure rate of 0.0298% over the given time period (again with system reliability or failure based on continued, proper functioning of two control pods in accordance with API Spec 16D). This represents a significant decrease in the system failure rate (over a 98.5% reduction in the failure rate) compared to the traditional two-pod system, and would substantially reduce costs associated with stoppage of drilling activities associated with malfunctioning systems.

Figure 3:
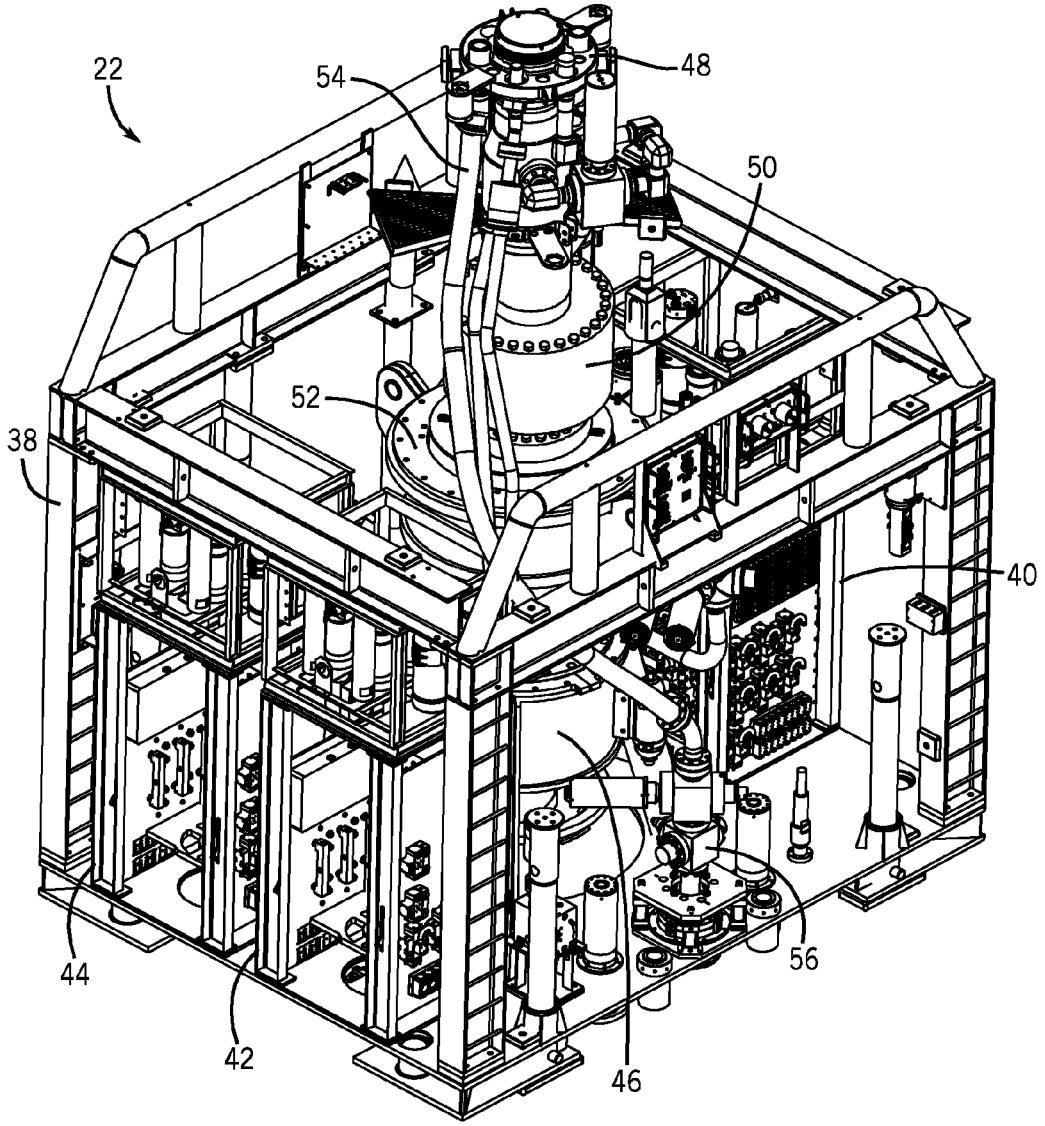
FIG. 3 is a front perspective view of a lower marine riser package having three control pods in accordance with one embodiment of the present disclosure.
Figure 4:
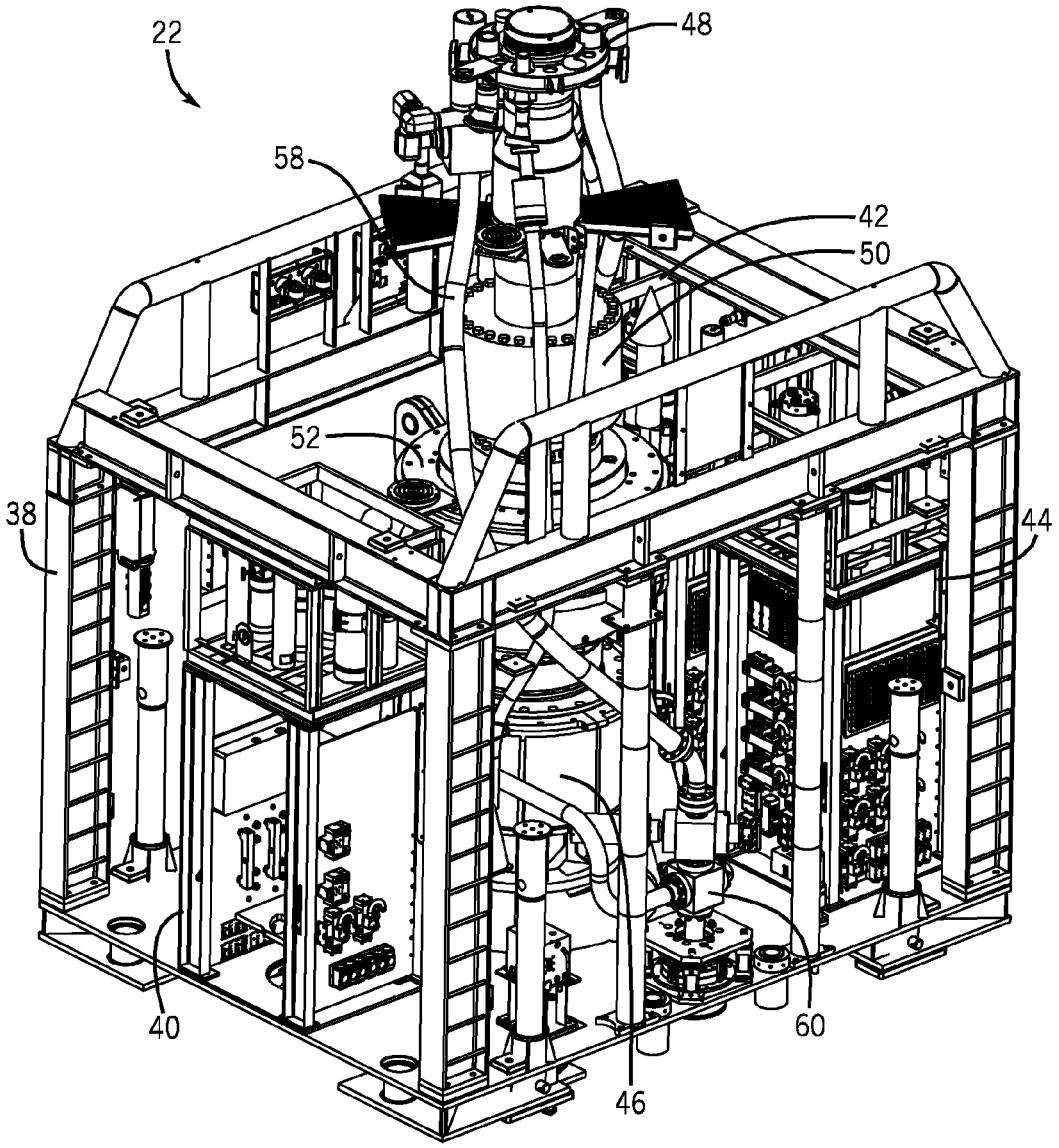
FIG. 4 is a rear perspective view of the lower marine riser package of FIG. 3.
Figure 5:
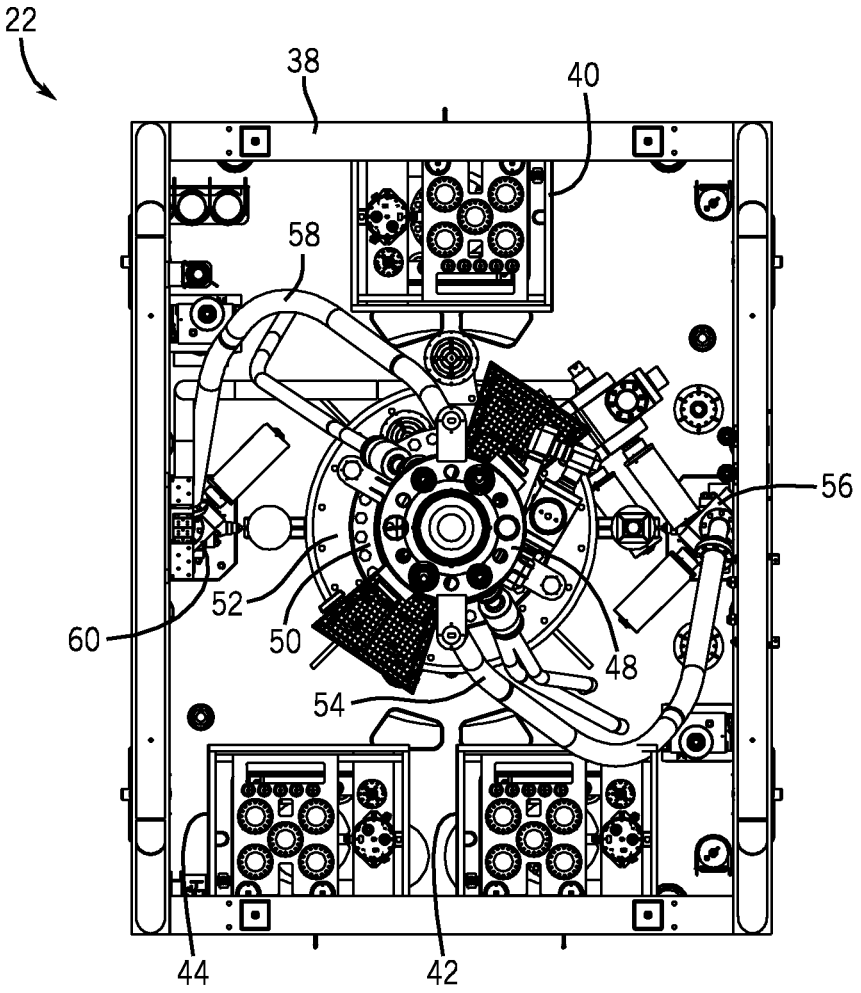
FIG. 5 is a top plan view of the lower marine riser package of FIGS. 3 and 4.

One embodiment having such an arrangement with three control pods for controlling hydraulic functions of stack equipment 18 is depicted in FIGS. 3-5 by way of example. In this embodiment, the lower marine riser package 22 includes not only a pair of redundant control pods 40 and 42 installed on a frame 38, but also a third redundant control pod 44. In other arrangements having only two control pods, one of the control pods is typically referred to as a "yellow" control pod while the other is referred to as a "blue" control pod. In the present embodiment, the control pods 40 and 42 may be referred to as yellow and blue pods, respectively, while the third control pod 44 could be referred to by any desired color, such as a "red" pod. In at least some embodiments, the control pods 40, 42, and 44 are functionally identical in that each of the control pods is capable of controlling all of the hydraulic functions that can be controlled by the other control pods. The control pods 40, 42, and 44 can control various numbers of hydraulic functions. In some embodiments, each of the control pods control from 48 to 144 hydraulic functions of the wellhead assembly, and in one embodiment each of the three control pods controls 120 hydraulic functions. In another embodiment, each of the three control pods controls 128 hydraulic functions. The three control pods 40, 42, and 44 represent a blowout preventer control assembly that can be coupled as part of a wellhead assembly. In the presently depicted embodiment, the control assembly includes the lower marine riser package 22 on which the control pods are mounted, but the control pods could also be mounted to a wellhead assembly in some other manner.

The depicted lower marine riser package 22 includes a hydraulic component 28 in the form of a connector 46. The connector 46 enables the lower marine riser package 22 to be landed on and then secured to the lower blowout preventer stack 24. On an opposite end of the assembly, a riser adapter 48 enables connection of the lower marine riser package 22 to the riser equipment 16 described above. As depicted, the lower marine riser package 22 also includes a flex joint 50 that accommodates angular movement of riser joints of riser equipment 14 with respect to the lower marine riser package 22 (i.e., it accommodates relative motion of the surface equipment 14 with respect to the stack equipment 18). The lower marine riser package 26 also includes a hydraulic component 28 in the form of a hydraulically controlled annular blowout preventer 52. And still further, the lower marine riser package 22 includes a kill line 54 (FIG. 3) and a choke line 58 (FIG. 4). These kill and choke lines 54 and 58 can be connected to the lower blowout preventer stack 24 by respective kill and choke connector assemblies 56 and 60.

Figure 6:
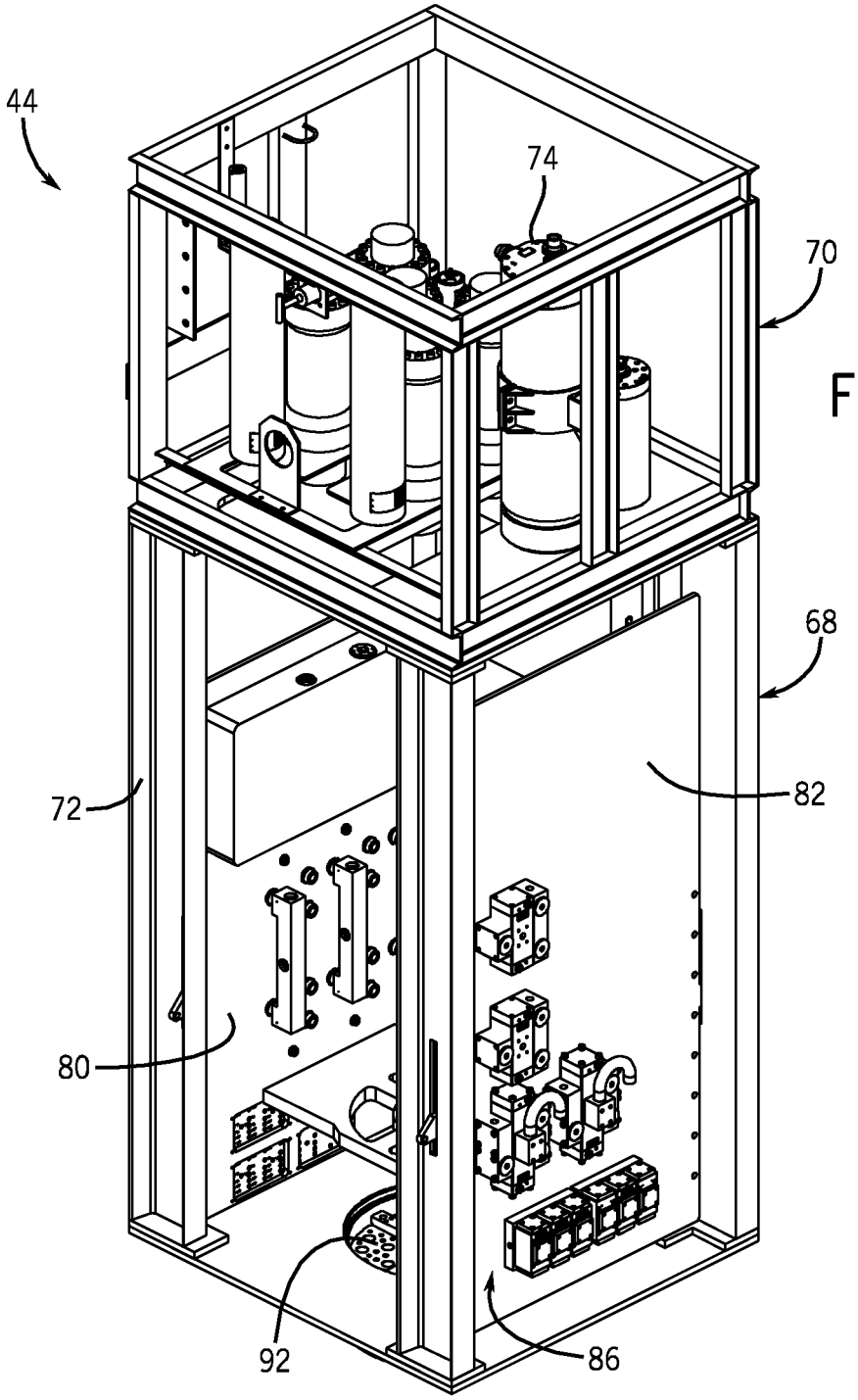
FIG. 6 is a front perspective view of one control pod of the lower marine riser package of FIGS. 3-5 having a stinger in accordance with one embodiment of the present disclosure.
Figure 7:
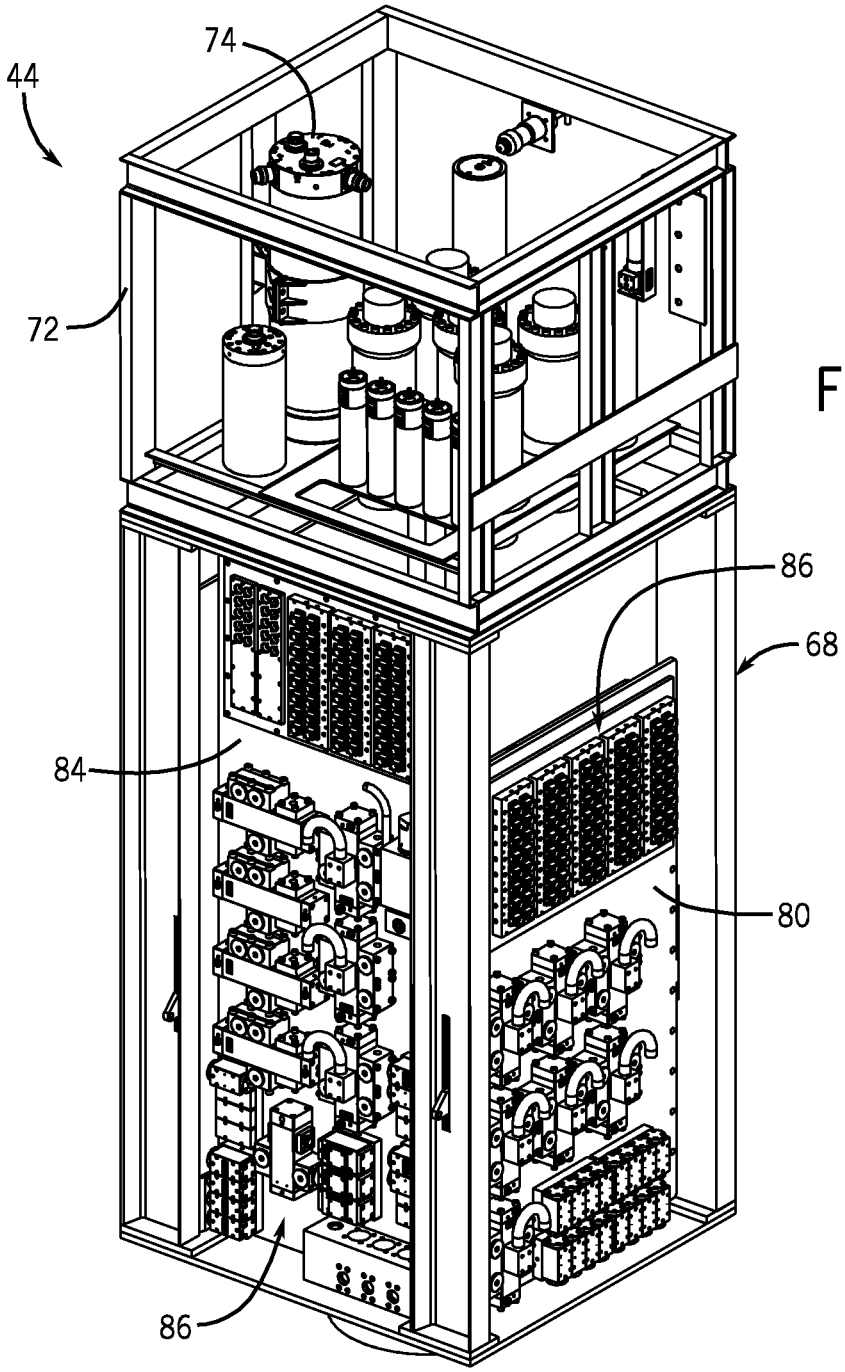
FIG. 7 is a rear perspective view of the control pod of FIG. 6.
Figure 8:
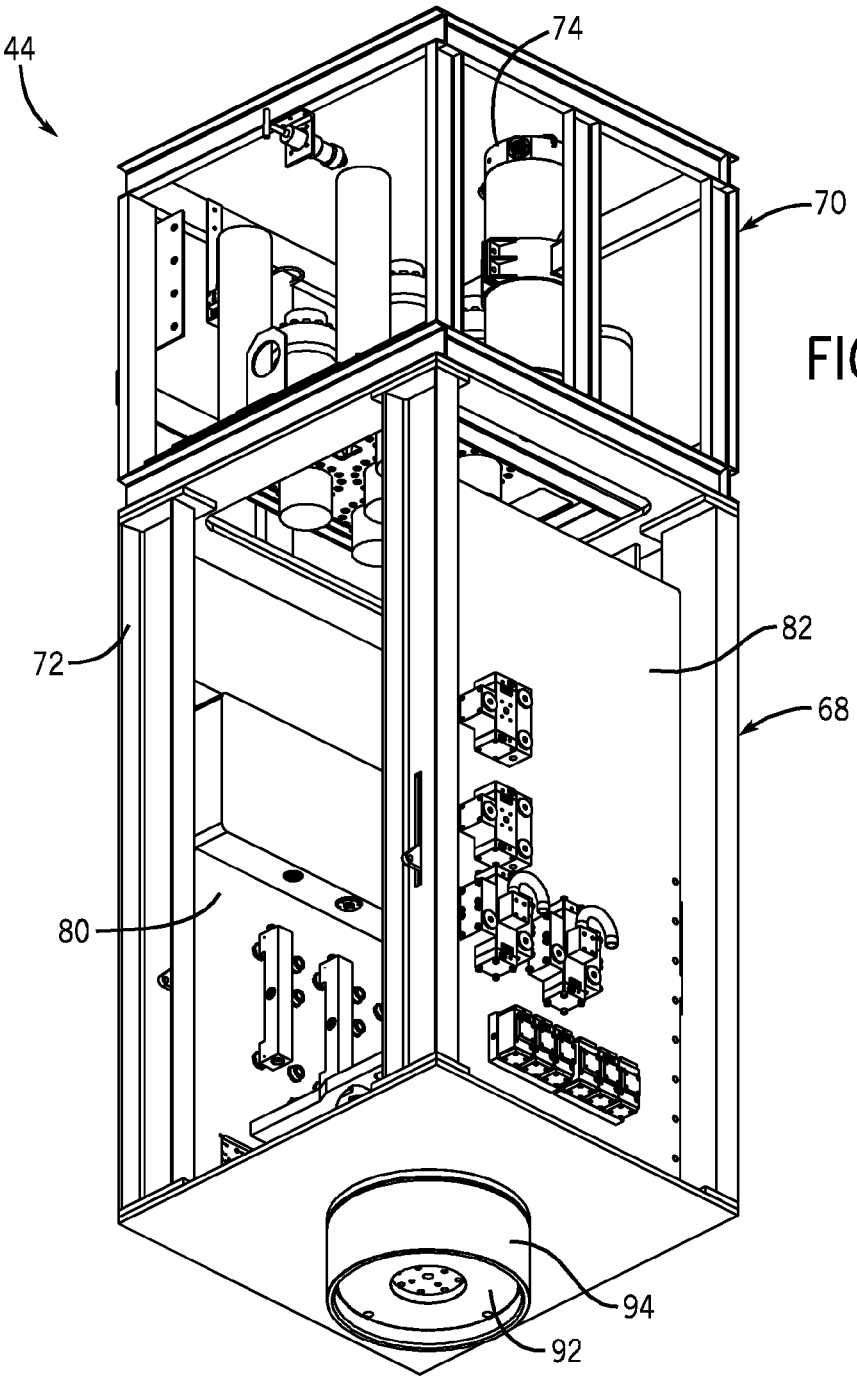
FIG. 8 is another perspective view of the control pod of FIGS. 6 and 7.

An example of one of the control pods installed on the lower marine riser package 22 of FIGS. 3-5 is depicted in greater detail in FIGS. 6-8. Although the control pod depicted in these additional figures is denoted control pod 44, it is noted that one or both of control pods 40 and 42 is identical to the control pod 44 in at least some embodiments. The control pod 44 includes a frame 72 with a lower section 68 and an upper section 70. The lower section 68 includes numerous valves for controlling flow of hydraulic control fluid to hydraulic components of the wellhead assembly and the upper section 70 (which may also be referred to as a multiplexing section) includes a subsea electronics module 74 that controls operation of the valves of section 68 based on received command signals. In the depicted embodiment, the lower section 68 includes panels or sub-plates 80,82, and 84 having sub-plate mounted valves 86.

The valves 86 can be connected to the hydraulic components 28 and 30 to control operation of these components. In one embodiment, those valves 86 that control hydraulic components 30 of the lower blowout preventer stack 24 are connected to those components 30 by control tubing routed to a stinger 92 of the control pod 44. And those valves 86 that control hydraulic components 28 of the lower marine riser package 22 are connected directly to their respective components 28 without being routed through a stinger. The stinger 92 of the present embodiment is a movable stinger that may be extended from and retracted into a shroud 94. Extension of the stinger 92 from the shroud 94 enables connection of the hydraulic components 30 of the lower blowout preventer stack 24 to their respective control valves 86. Accordingly, the stinger 92 may also be referred to as a stack stinger. This is in contrast to a riser stinger (not included in the presently depicted embodiment), which would facilitate connection of valves of a control pod to hydraulic components of a lower marine riser package. The shroud 94 protects the stinger 92 during installation of the control pod 44 on the lower marine riser package 22 and during landing of the lower marine riser package 22 on the lower blowout preventer stack 24.

Figure 9:
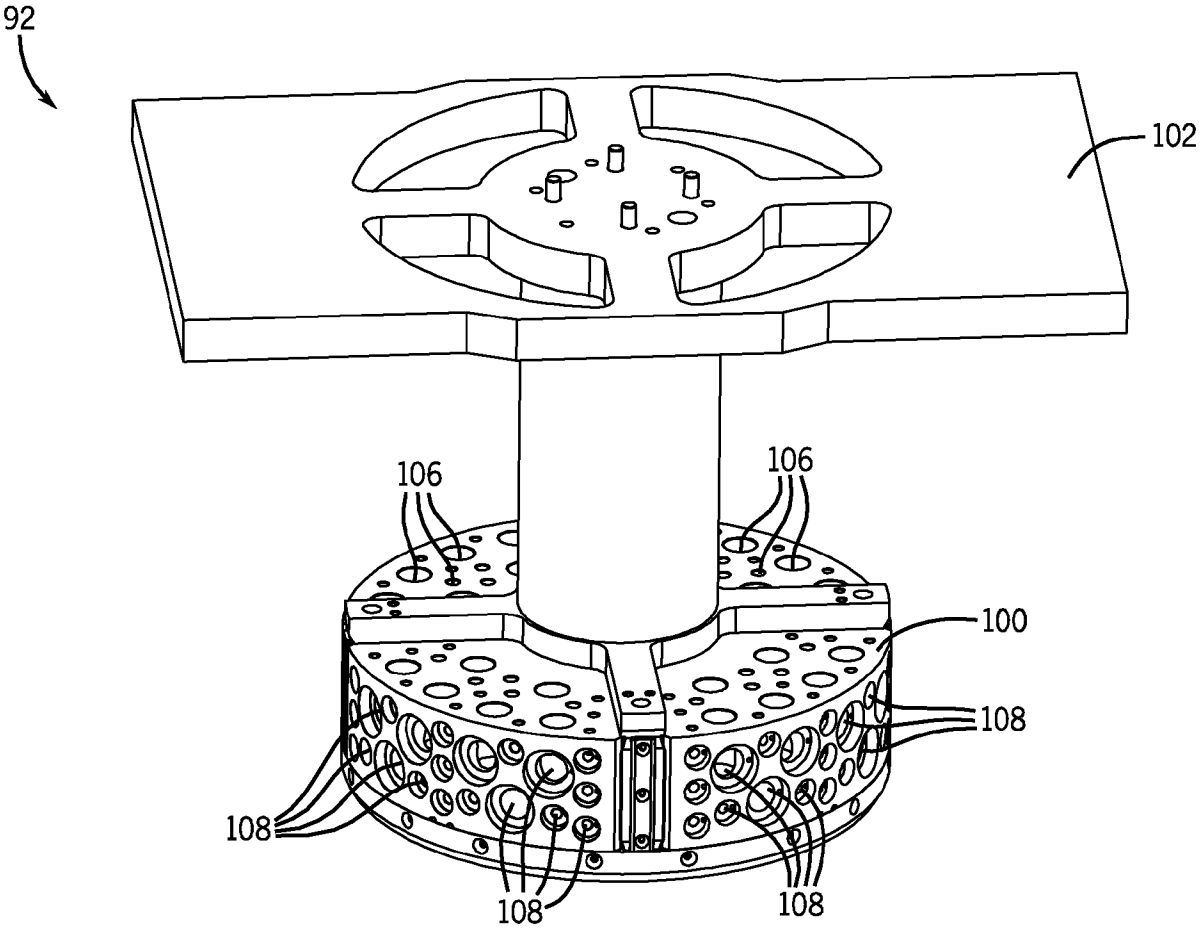
FIG. 9 is a perspective view of the stinger of the control pod depicted in FIGS. 6-8.

As shown in FIG. 9, the stinger 92 includes a fluid distribution hub 100 connected to a plate 102. In the depicted embodiment, the hub 100 includes four wedge-shaped elements with inlets 106 and outlets 108. Those valves 86 that control hydraulic components 30 of the lower blowout preventer stack 24 may be coupled (e.g., with hydraulic control tubing) to the inlets 106, which themselves are connected with the outlets 108 via internal conduits in the hub 100. When the lower marine riser package 22 is landed on the lower blowout preventer stack 24, the stingers 92 of the control pods 40, 42, and 44 can be extended to mate with respective adapters (e.g., control pod bases) constructed to route control fluid from the outlets 108 to the hydraulic components 30 of the lower blowout preventer stack 24. The outlets 108 are depicted as including recessed shoulders for receiving seals to inhibit leaking at the interface between the outlets 108 and the mating adapters that receive the stingers 92. And in some embodiments, the wedge-shaped pieces of the hub 100 can be driven outwardly into engagement with the mating adapter to promote sealing engagement of the seals against the mating adapter.

Figure 10:
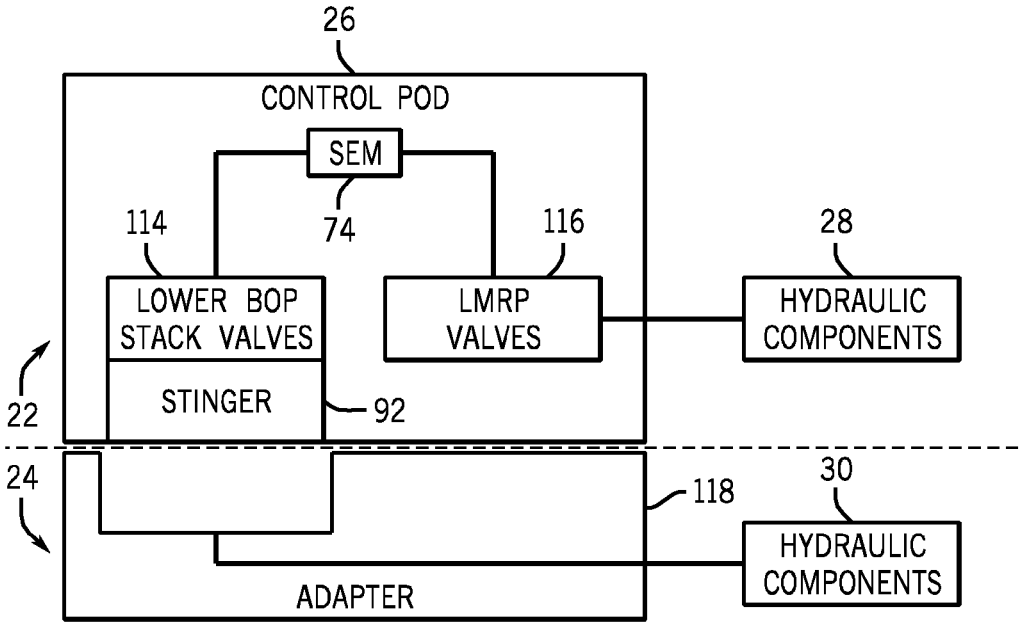
FIGS. 10 and 11 are block diagrams generally depicting hydraulic components controlled by a control pod and the extension of the stinger to mate with an adapter of a lower blowout preventer stack in accordance with one embodiment.
Figure 11:
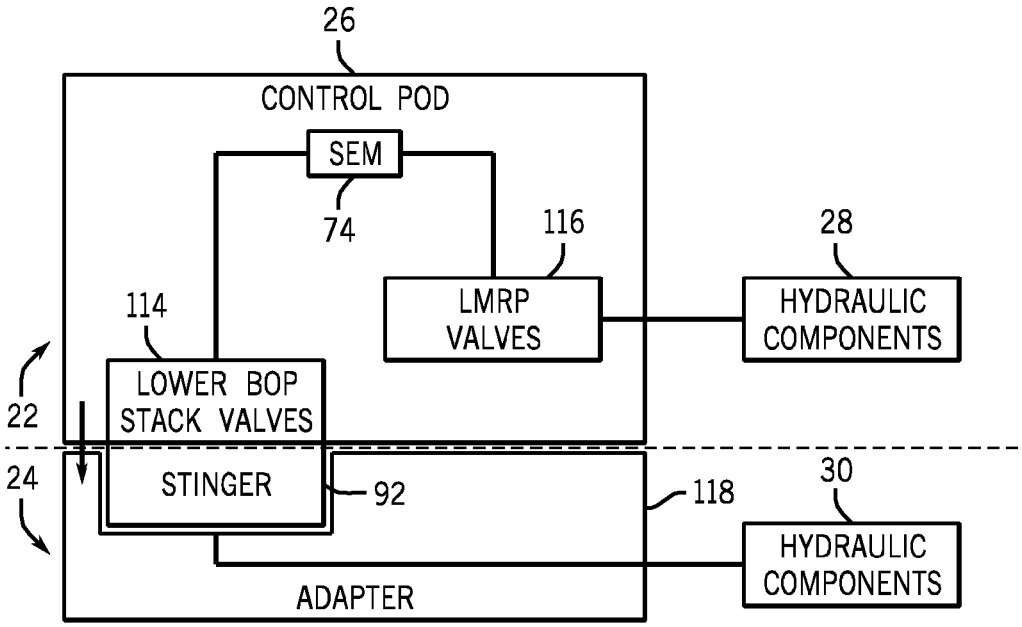

An example of a control pod 26 having a stinger that can be extended to engage a mating adapter on a lower blowout preventer stack is depicted in FIGS. 10 and 11. As described above, components of the lower marine riser package 22 include control pods 26 and hydraulic components 28, while the lower blowout preventer stack 24 includes hydraulic components 30. And as shown in FIGS. 10 and 11, the lower blowout preventer stack 24 also includes at least one adapter 118 that receives the mating stinger 92 of the control pod 26. Although FIGS. 10 and 11 only depict a single control pod 26 and a single adapter 118 for the sake of explanation, it will be appreciated that the lower marine riser package 22 may include a greater number of control pods 26 (e.g., three control pods) and the system may include adapters 118 in sufficient number to receive the control pods.

In one embodiment, the valves 86 include lower blowout preventer stack valves 114 for controlling hydraulic components 30 and lower marine riser package valves 116 for controlling hydraulic components 28. The valves 114 and 116 are controlled by instructions from the subsea electronics module 74. In the embodiment generally depicted in FIGS. 10 and 11, the lower marine riser package valves 116 are coupled directly to the hydraulic components they control (e.g., by hydraulic control tubing) rather than being routed through a riser stinger. In contrast, the lower blowout preventer stack valves 114 are hydraulically coupled to the stinger 92 (e.g., also with hydraulic control tubing). The stinger 92 can be extended from the control pod 26 into the adapter 118, as generally represented by the downward arrow next to the stinger 92 in FIG. 11. In the presently depicted embodiment, the lower blowout preventer stack valves 114 are not only hydraulically coupled to the stinger 92, but they are also connected with the stinger 92 such that the valves 114 move with the stinger 92 as it is extended or retracted with respect to the control pod 26. For example, the valves 114 may be installed on one or more panels coupled to move with the stinger 92, while the valves 116 can be installed on one or more different panels that do not move with the stinger 92.

Figure 12:
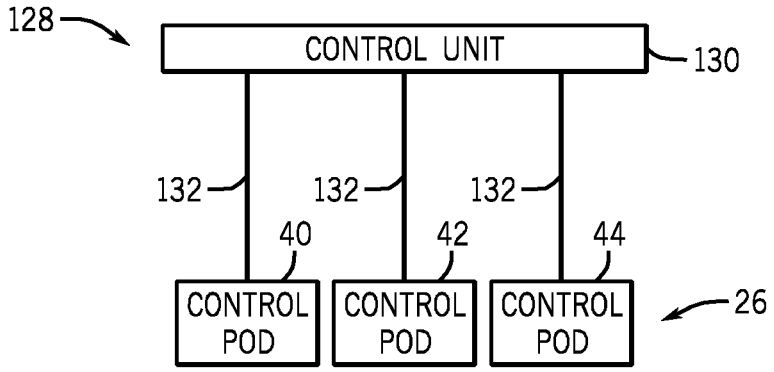
FIGS. 12-14 are block diagrams depicting various configurations of control cables for routing instructions to the control pods of a blowout preventer system in accordance with several embodiments.
Figure 13:
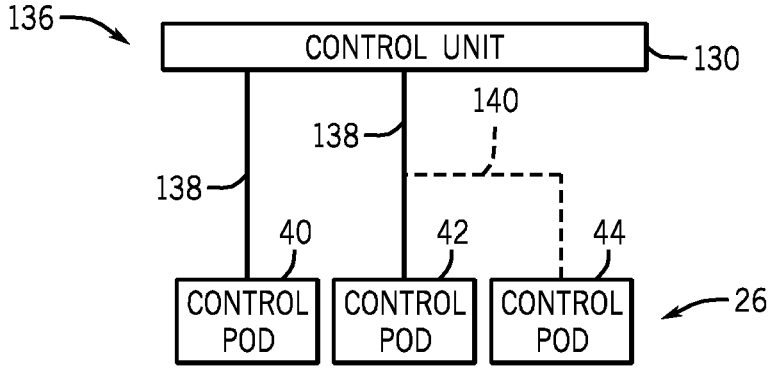
Figure 14:
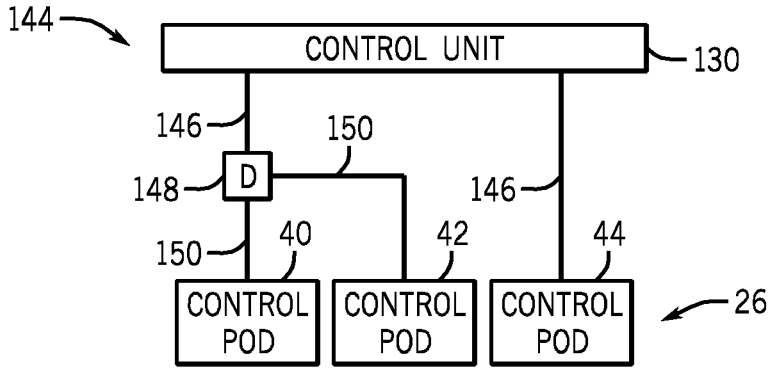

Various ways of connecting the control pods 26 to a control unit 130 are generally depicted in FIGS. 12-14 in accordance with certain embodiments. In a control system 128 of FIG. 12, for instance, each of the control pods 40, 42, and 44 is connected to the control unit 130 by a respective cable 132. The control unit 130 can include any suitable equipment (e.g., computers, human-machine interfaces, and networking equipment with appropriate software) for communicating instructions to the control pods 26. The cables 132 enable command signals (i.e., control instructions) to be sent from the control unit 130 to the control pods 26 (e.g., to the subsea electronic modules 74 of the control pods). In at least some embodiments, the cables 132 are provided on cable reels. The command signals can be sent to the control pods 26 sequentially or redundant command signals can be sent simultaneously to the control pods 26. In some embodiments, the control system can detect malfunctioning of one of the three control pods 26. But because the system includes three control pods, drilling operations may continue in accordance with API Spec 16D using the two remaining, non-malfunctioning control pods 26.

While each control pod 26 can be connected to its own cable 132 for receiving instructions, other arrangements could also be used in a given application. For example, the control system 136 of FIG. 13 includes only two signal cables 138 for passing instructions from the control unit 130 to the control pods 26. The two cables 138 can first be connected to two of the control pods 26 (here control pods 40 and 42). But either of the cables 138 could be disconnected from a control pod (a malfunctioning control pod, for instance) and then reattached to a new control pod, as generally represented by the dashed line 140 in FIG. 13. In some instances, this disconnecting and reattaching of the cable 138 could be performed (e.g., by a subsea remote operated vehicle) while the control pods 26 remain installed on the subsea wellhead assembly and while the subsea wellhead assembly remains installed at the subsea well. And as yet another example, the control system 144 of FIG. 14 includes a pair of cables 146 connected at one end to the control unit 130. But while one of the two cables 146 is routed through to a control pod 26 (here control pod 44), the other of the cables 146 is connected to a distribution point 148 (e.g., a multiplexer), with additional cables 150 connecting the distribution point 148 to the other control pods 26 (here control pods 40 and 42).

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A blowout preventer system comprising:

a blowout preventer stack including hydraulic components; and a lower marine riser package coupled to the blowout preventer stack and including additional hydraulic components, the lower marine riser package also including:

a pair of control pods that enable redundant control of the hydraulic components of the blowout preventer stack and the additional hydraulic components of the lower marine riser package, wherein each of the control pods includes: a stack stinger that facilitates connection of the control pod to the hydraulic components of the blowout preventer stack, a plurality of valves for routing control fluid to the hydraulic components of the blowout preventer stack, and a control pod frame having a bottom plate with a central aperture; wherein the plurality of valves for routing control fluid to the hydraulic components of the blowout preventer stack are mounted within the control pod frame; wherein the stack stinger extends through the central aperture of the bottom plate of the control pod frame and facilitates communication of control fluid from the plurality of valves to the hydraulic components of the blowout preventer stack through the stack stinger; and wherein none of the control pods includes a riser stinger that facilitates communication of control fluid to the additional hydraulic components of the lower marine riser package.

2. The blowout preventer system of claim 1, wherein the hydraulic components of the blowout preventer stack include at least one pair of hydraulically controlled rams.

3. The blowout preventer system of claim 1, wherein the additional hydraulic components of the lower marine riser package include a hydraulically controlled annular blowout preventer.

4. The blowout preventer system of claim 1, comprising a plurality of cables that enable control signals to be routed to the control pods from a control unit, wherein each of the control pods is coupled to a respective cable of the plurality of cables to allow receipt of control signals by each of the control pods.

5. A blowout preventer system comprising a blowout preventer control assembly that is configured to be coupled as part of a wellhead assembly that includes at least one blowout preventer, the blowout preventer control assembly including redundant control pods that facilitate control of hydraulic functions of the wellhead assembly, wherein the redundant control pods are functionally identical to one another, wherein each of the redundant control pods includes: a stack stinger that facilitates connection of the control pod to hydraulic components of the wellhead assembly that are installed on a lower blowout preventer stack, a plurality of valves for routing control fluid to the hydraulic components of the wellhead assembly that are installed on a lower blowout preventer stack, and a control pod frame having a bottom plate with a central aperture; wherein the plurality of valves for routing control fluid to the hydraulic components of the wellhead assembly that are installed on the lower blowout preventer stack are mounted within the control pod frame; wherein the stack stinger extends through the central aperture of the bottom plate of the control pod frame and facilitates communication of control fluid from the plurality of valves to the hydraulic components of the wellhead assembly that are installed on the lower blowout preventer stack through the stack stinger; and wherein none of the control pods includes a riser stinger that facilitates communication of control fluid to additional hydraulic components of the wellhead assembly that are installed on a lower marine riser package.

6. The blowout preventer system of claim 5, wherein each of the redundant control pods is configured to control from 48 to 144 hydraulic functions of the wellhead assembly.

7. The blowout preventer system of claim 5, comprising the at least one blowout preventer.

8. The blowout preventer system of claim 5, comprising the lower marine riser package.

9. The blowout preventer system of claim 8, wherein the redundant control pods are mounted on the lower marine riser package.

10. A control pod comprising:

a stack stinger that facilitates connection of the control pod to hydraulic components of a blowout preventer stack of a blowout preventer system;

a plurality of valves for routing control fluid to the hydraulic components of the blowout preventer stack; and a control pod frame having a bottom plate with a central aperture;

wherein the plurality of valves for routing control fluid to the hydraulic components of the blowout preventer stack are mounted within the control pod frame; wherein the stack stinger extends through the central aperture of the bottom plate of the control pod frame and facilitates communication of control fluid from the plurality of valves to the hydraulic components of the blowout preventer stack through the stack stinger; and wherein the control pod does not include a riser stinger that facilitates communication of control fluid to additional hydraulic components of a lower marine riser package of the blowout preventer system.

* * * * *